United States Patent [19]

Sullivan, Jr. et al.

[11] 4,438,698

[45] Mar. 27, 1984

[54] ENDORSING APPARATUS UTILIZING HOLDING FORCE PRESSURE

[75] Inventors: John L. Sullivan, Jr., Fort Lauderdale; Robert D. Pearson, Pompano Beach; Donald A. Youngblood, Fort Lauderdale, all of Fla.

[73] Assignee: Burroughs Corporation, Orlando, Fla.

[21] Appl. No.: 510,741

[22] Filed: Jul. 5, 1983

Related U.S. Application Data

[63] Continuation of Ser. No. 416,650, Sep. 10, 1982, abandoned, which is a continuation of Ser. No. 182,600, Aug. 29, 1980, abandoned.

[51] Int. Cl.[3] ..... B41F 1/00

[52] U.S. Cl. ..... 101/287; 101/91

[58] Field of Search ..... 101/91, 235, 245, 287, 101/324, 326, 93, 407 BP

[56] References Cited

U.S. PATENT DOCUMENTS

| | | | |
|---|---|---|---|
| 2,887,043 | 5/1959 | Terry | 101/407 BP |
| 3,388,659 | 6/1968 | Hu | 101/269 |
| 3,583,314 | 6/1971 | Gillender | 101/91 |
| 3,608,809 | 9/1971 | Cushman | 101/287 X |
| 3,815,497 | 6/1974 | Wallace | 101/91 X |
| 4,015,701 | 4/1977 | Templeton | 101/91 X |
| 4,056,183 | 11/1977 | Beery | 101/324 X |
| 4,133,262 | 1/1979 | Beery | 101/91 X |
| 4,152,984 | 5/1979 | Utzinger | 101/324 X |
| 4,178,847 | 12/1979 | Erhardt | 101/91 |
| 4,194,488 | 3/1980 | Becher et al. | 101/324 X |

*Primary Examiner*—E. H. Eickholt

*Attorney, Agent, or Firm*—Carl Fissell, Jr.; Kevin R. Peterson; Edmund M. Chung

[57] ABSTRACT

A self-supported, free standing, demountable, printing-/endorsing apparatus including a demountably removable, replaceable, adjustable printing module having ribbon transporting and re-inking means integral therewith. Solenoid actuated means operably, drivingly connected to an impact member for impact engagement with the demountable printing member enabling the device to print on an item. Secondary impression producing means is demountably carried by the printing means and is adjustable relative to the impact member and together with the impact member forms an item receiving pathway normal to the impact member through which the item is transported. The impact member is Gimbal mounted relative to the pathway effectively enabling printing without regard to the flatness of the subject matter of the item, and without the prior art high impact forces generally employed.

8 Claims, 22 Drawing Figures

ENDORSING APPARATUS UTILIZING HOLDING FORCE PRESSURE

This application is a continuation of application Ser. No. 416,650, filed Sept. 10, 1982, which is a continuation of Ser. No. 182,600, Aug. 29, 1980, both abandoned.

BACKGROUND OF THE INVENTION

1. Field of the Invention

The invention relates generally to the field of printing apparatus and more specifically to item endorsing apparatus for documents such as checks, utilizing holding force pressure in contrast to the usual high impact forces generally employed for imprinting.

2. Description of the Prior Art

Prior art fixed information endorsers suffer from a number of deficienceis including lack of suitable means for altering the changeable information/data at will and the high cost of the drive means usually associated with such apparatus. Also, where it is desirable or necessary to alter or change the endorsement legend the mechanisms employed in the past have been fairly clumsy, difficult and inefficient for the ordinary operator to handle effectively. Further, driving linkages employed with prior art endorsers are often complex and relatively expensive both to fabricate, repair and/or replace.

Most, if not all, prior art endorsers are capable of operation from one side only of the machine with which they are employed, thus necessitating a model change where it is desired or necessary to operate the apparatus from the opposite side, i.e. right to left, left to right, front to back, or back to front, with respect to the item drive pathway employed with the particular piece of apparatus.

SUMMARY OF THE INVENTION

It is an important object of the present invention to provide a relatively low cost, reliable and efficient document/item endorser apparatus effective for printing both fixed and variable information/data on documents such for example as checks as the documents are passed at relatively high speed along a transport pathway from an input hopper to an output receiving hopper.

Another important object of the present invention is to provide for the printing of both fixed and variable information wherein the variable information is automatically updated, changed or altered in accordance with a variable signal input to the apparatus.

Still another important object of the invention is to provide a simple, easily demountable, adjustable endorsement legend mount which provides means for changing or altering the fixed endorsement information without altering the indexable fixed and/or variable information.

Another object of the invention is the provision of a novel solenoid drive means producing a relatively linear force which is applied to the fixed and variable data printing apparatus.

It is also an object of the invention to provide a Gimbal mounted platen member having orthogonal degrees of freedom permitting the platen to accommodate any deflection of structural members as well as any constructional misalignment between the platen and the print head relative to the item therebetween.

Still a further object of the invention is to provide means for separating the platen driving means from the platen per se, to take care of misalignment between the armature of the print solenoid and the platen shaft effective to reduce the required driving forces while still obtaining adequate imprinting force for good, legible printing on the item.

It is also an object of the invention to provide a solenoid actuating member wherein the force transmitted to the sequence wheel printing apparatus increases as the actuation takes place and is controllable to be a constant force or increase at a controlled rate as desired.

The invention provides, in accordance with these and other objects, a solenoid driven Gimbal mounted platen member which pressure impacts a print head comprising opposed sets of rotatable print members having a demountable, adjustable print bearing legend means disposed therebetween. A drive member rotates an operably associated ink roller for transferring ink from an adjustably positionable ink roll to a wide band inking ribbon operably movable over the print members so as to transfer ink to the item as printing is required. A solenoid and clapper mechanism provide means for applying sufficient predetermined torque to the print members for advancing the print members against the build up of forces due to the accumulation of ink on the print faces during printing.

In one important modification of the printing apparatus the print head is demountably captivated but removable and replaceable by means of a lever and stop associated therewith without disturbing the inking ribbon while the ink roll is provided with means for adjusting the tension of the ink roll adjacent to the ink transfer roll due to ink depletion as a result of usage. The adjustable legend mount is arranged to be slideably disposed between the two sets of print wheel members of the print head and is horizontally, vertically movable relative to the platen member and printing pathway to adjust the legend bearing mount member for wear of the legend material due to usage. Ribbon slack adjusting means is provided so as to keep the ribbon under suitable tension as the apparatus is utilized.

BRIEF DESCRIPTION OF THE DRAWINGS

The foregoing and other objects and advantages and features of the invention will become more readily apparent from the following detailed description when read in conjunction with the accompanying drawing figures, in which.

DESCRIPTION OF A PREFERRED EMBODIMENT

The present invention includes a number of novel and heretofore unobvious aspects not to be found in the known prior art, and as will become clearer as the present description proceeds, provides a manner of operation and functional arrangement which enables the printing/endorsing apparatus to work in a much more efficient and easier to service arrangement than was heretofore available.

Two slightly different but interrelated structural embodiments are described and claimed herein. In one embodiment the endorser print head is fabricated to be, and generally and usually is, fixed in position. However, as will be described later on, removal of one bolt permits the entire print assembly including the print head, ribbon, ribbon track and ribbon drive, to be disassembled as a unit for repair as required. In a second embodiment the endorser print head is demountably removable and replaceable leaving the inking ribbon and inking drive assembly in place. The inking assembly is, however, adjustably tensioned relative to the ink transfer member.

FIXED PRINT HEAD EMBODIMENT

Figure 1:
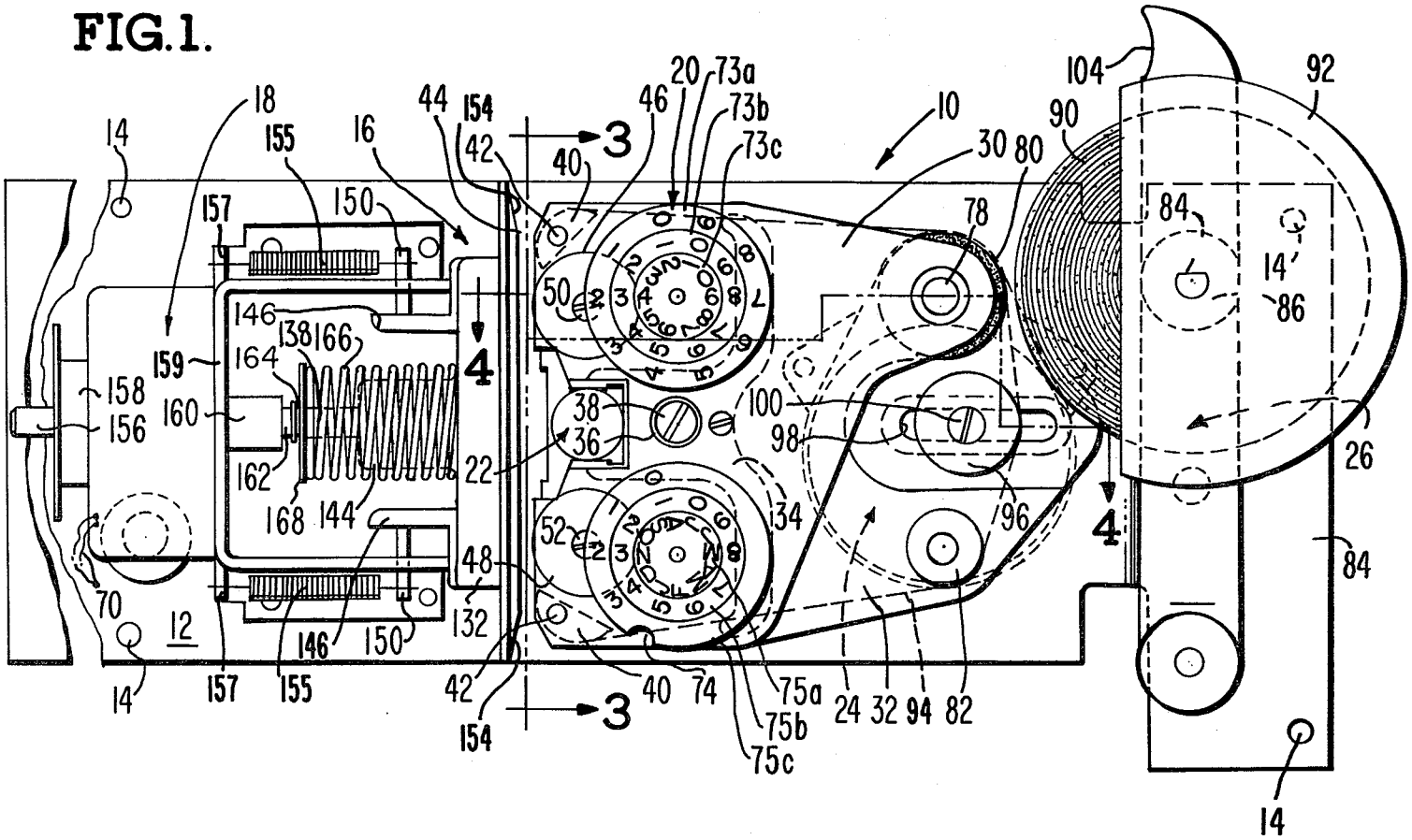
FIG. 1 is a top plan view of a preferred embodiment of the present invention illustrating the fixed print head construction.
Figure 2:
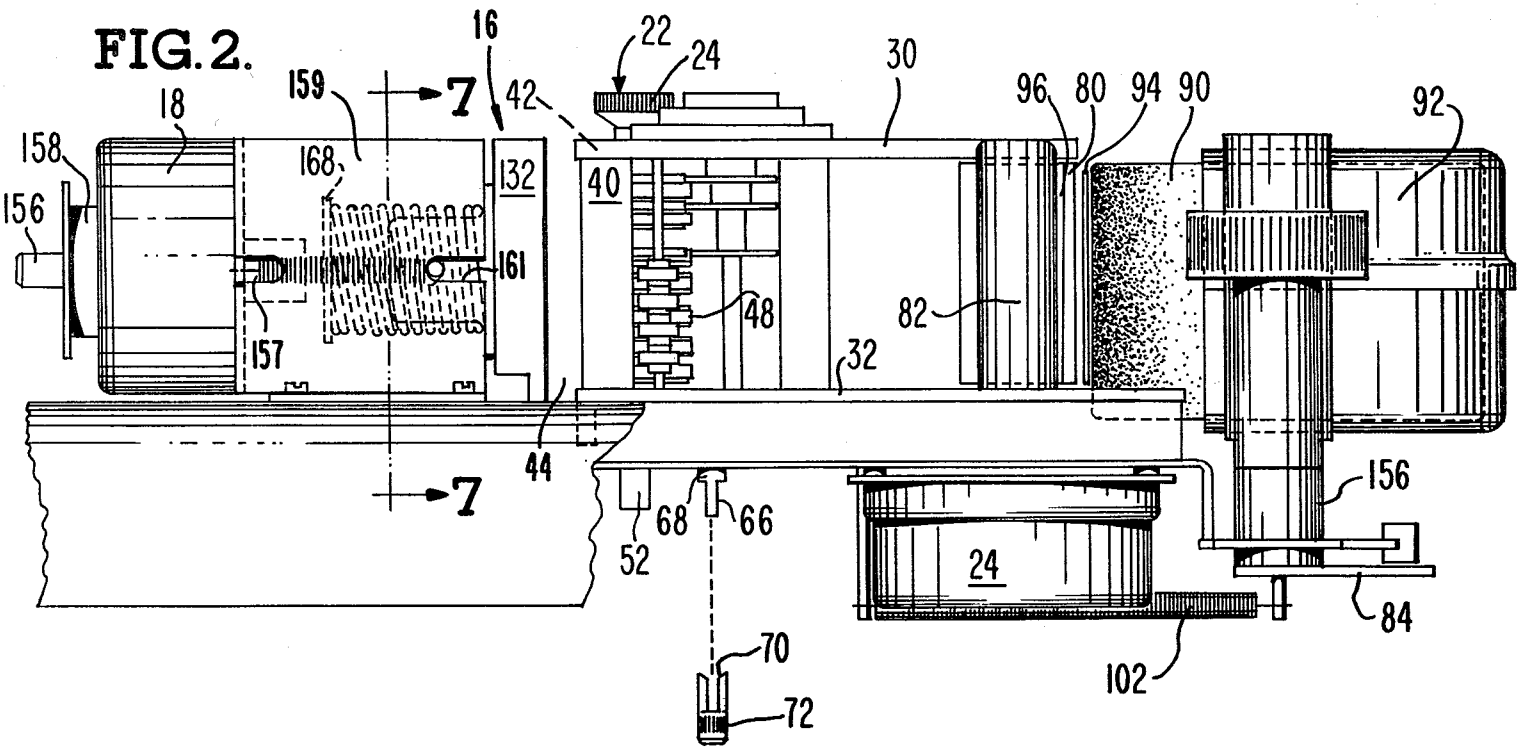
FIG. 2 is a side elevational view of the apparatus of FIG. 1.
Figure 10:
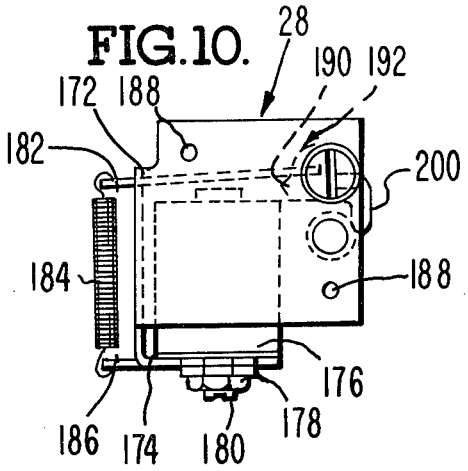
FIG. 10 is an illustration of the solenoid and clapper drive arrangement for advancing the printing elements of the print head of the apparatus in FIG. 1.
Figure 11:
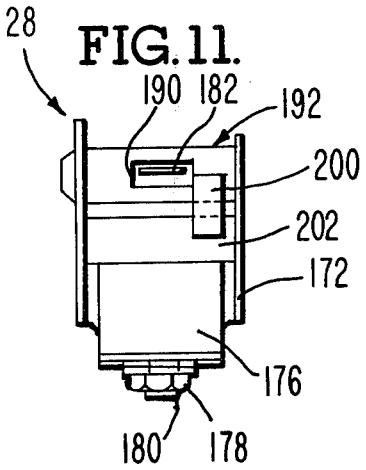
FIG. 11 is a right side view of the apparatus of FIG. 10.
Figure 15:
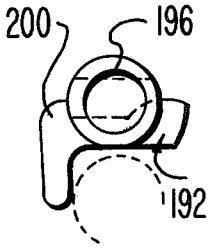
FIG. 15 is a view taken along the line 15—15 of FIG. 12.
Figure 12:
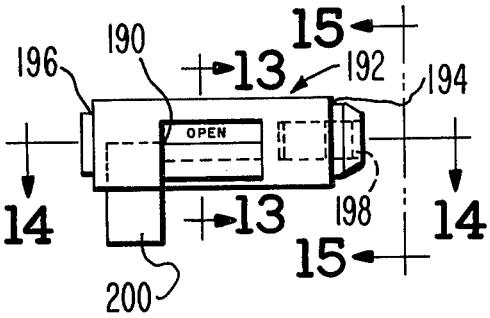
FIG. 12 is a view of the solenoid clapper actuator for the device of FIGS. 10 and 11.
Figure 13:
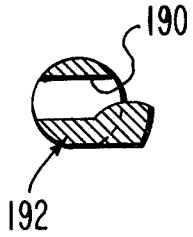
FIG. 13 is a view taken along the line 13—13 of FIG. 12.

The present invention, as seen in FIGS. 1, 2 and 10, is structurally arranged to be demountably, removable as a modular assembly 10 supported on an elongated "U" shaped channel member 12 of aluminum, steel or similar hardened but lightweight rigid material which forms a base support provided with means such as mounting holes 14 for attachment bolts, not shown, for mounting the same within the confines of a larger machine with which the printing apparatus is or may be utilized. The apparatus of the present invention may be divided (for convenience of description and explanation only) into a number of subassemblies.

1. Platen assembly 16.
2. Platen drive solenoid 18.
3. Adjustable print head 20.
4. Demountable endorsement legend printing means 22.
5. Ink roll drive means 24.
6. Inking means tensioning adjustment 26.
7. Print head drive means 28. (FIG. 10)

Print head 20 of Endorser 10 is seen in FIGS. 1 and 2 to comprise an upper and a lower irregularly shaped support member 30 and 32 respectively. A central curvilinear, T-shaped member 34 (shown in dotted outline in FIG. 1) acts as a rigid vertical separator/spacer/support between members 30 and 32 and includes a centrally disposed mounting aperture 36 receiving a threaded attachment bolt 38 for securing the print head unit 20 to the base 12. Arcuately, radially curved corner posts 40 provided with slight undercut vertical extensions or projections 42 orient and align the upper support 30 adjacent the lower support 32 relative to an item receiving pathway 44.

Figure 14:
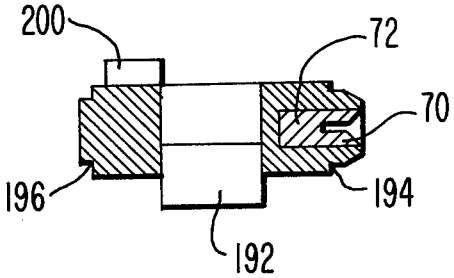
FIG. 14 is a view taken along the line 14—14 of FIG. 12.

Two independently movable (rotatable) sets of print wheels 46 and 48 within the print head 20 (shown in side elevation in FIGS. 2, 3, and 4) are carried on respective support shafts 50 and 52. The lower end of each shaft 50 and 52 project into and through the base 12 and act as locating devices for accurately squarely locating the print head mechanism relative to the item pathway 44. Item batch indexing wheel set 46 carries at its lower extreme end a verge mechanism 54, FIGS. 3 and 4, otherwise known as an escapement including an escapement pawl 56, FIG. 16, operably engageable with a rotatable pin wheel 58 (FIGS. 4 and 16) carrying a plurality of peripherally disposed equally spaced pins 60 alternately engaged by opposite ends 62 and 64 of verge mechanism pawl 56. Oppositely disposed flats 66 formed on the lower end of verge shaft 68 permit ink verge shaft 68 to engage a slot 70 in insert member 72, FIG. 14, for purposes to be explained presently herein. Print wheels 46 and 48 are or may be of the type referred to as Veeder-Root counters manufactured by Veeder-Root, 70 Sargeant Street, Hartford, Conn. 06102, as seen most clearly in the side elevational view of FIG. 3.

Rotational presetting adjustment of the print wheels is easily accomplished by means of three concentric offset dials 73*a*, 73*b*, and 73*c* for the item/document batch and numbering counter 46, while concentric dials 75*a* and 75*b* are settable for the day and month counter 48. An arcuate indent 74 in the lowermost counterdial of counterdial set 75 permits access to an adjusting screw 76 for setting the year.

The rightward end of the head structure 20 supports an ink drive roller shaft 78 carrying ink ribbon drive roll 80. A free standing ribbon guide post 82 is located at the lower right radial corner of base 32. Reduction gearing (not shown) operably associated with the ink roller drive motor 24, FIG. 2, transfers rotative torque to the ribbon inking drive roll 80.

Frame 12 (channel/U-shaped) is formed with a step-like, relatively narrow support or platform 84 integral with the rightward end. A vertical, cylindrical post 86 having a flat 88 formed or milled into the uppermost end thereof is secured at its base to the support 84 and is arranged to demountably support a rotatable ink supply roll 90 of Porelon ® or like material, housed in an open sided cover 92 adapted to seat upon the flat 88 of shaft 86 so as to prevent rotative movement of the cover while maintaining the exposed area of the ink supply roll in contact with the ink drive roller 80 and preventing ink splatter or spray. A wide band inking ribbon 94 is provided for printing as the print wheels of the print head 20 are brought into contact with an item through the ribbon within pathway 44. So as to prevent too much slack from developing in the ribbon band 94, a horizontally, slideably adjustable, vertical post 96, movable within the slot 98, is arranged to apply suitable tension to ribbon 94 to take up any excess slack which may develop during use. A bolt 100 extending through the vertical post 96 tightens the post into a fixed position on the base member 32. Slight spring tension from spring 102, FIG. 2, biases inking roller 90 against the drive roller 80. Operator pressure against the finger notch 104 of lever 106 permits the inking roll 90 to move rightwardly or leftwardly enabling the operator to renew the inking roll when the ink is depleted therefrom while spring 102 maintains suitable pressure or tension on the drive roll 80 and ribbon 94.

Figure 3:
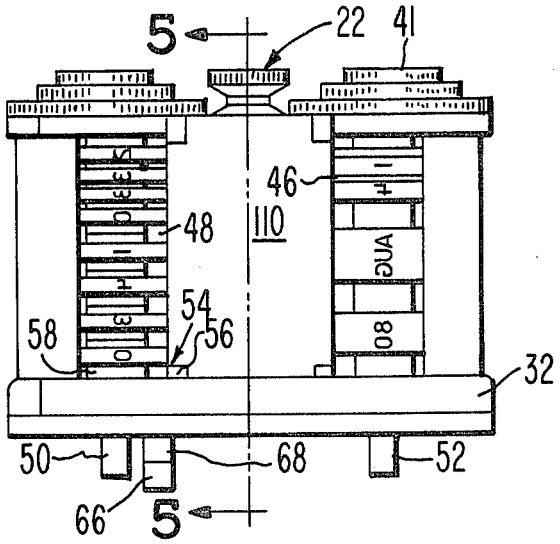
FIG. 3 is a view taken along the line 3—3 of FIG. 1.
Figure 4:
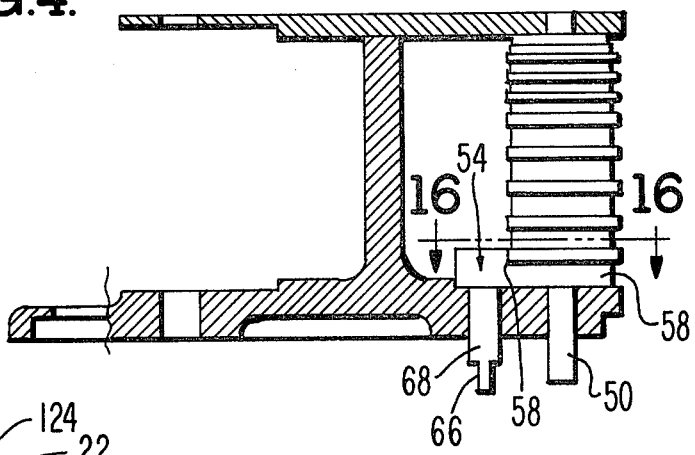
FIG. 4 is a view taken along the line 4—4 of FIG. 1.
Figure 5:
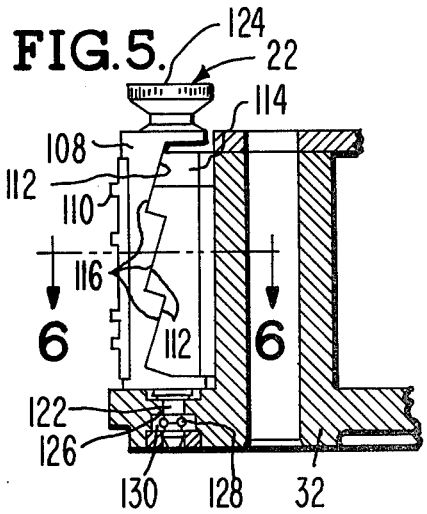
FIG. 5 is a view taken along the line 5—5 of FIG. 3.
Figure 6:
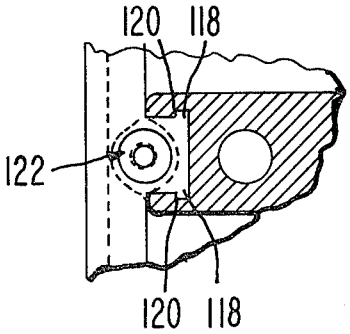
FIG. 6 is a view taken along the line 6—6 of FIG. 5.

As earlier mentioned herein, the present invention provides a demountably, removable, easily replaceable, adjustable endorsement legend mount 22. As seen in FIGS. 3, 5 and 6, with particular reference to FIG. 5, this mechanism comprises a front endorsement legend carrier or holder 108 into which a suitable endorsement legend 110 is or may be press fitted or adhesively applied. The legend may comprise a Buna-N or rubber member provided with suitable information in the form of printing, symbols, pictographs, etc. as desired or required for the specific use. The rear surface of member 108 is cut, milled, shaped or molded to provide a series of stair-steplike wedges 112, three such wedges being illustrated in FIG. 5. The opposite facing member 114 also carrying three complimentary wedges 116 is roughly T-shaped in cross section with the outboard ends 118, FIG. 6, of the cross bar of the "T" slideably receivable in oppositely disposed mating grooves or channels 120 vertically disposed in the central separator/support member 34, FIG. 1. A vertically threaded elongated shaft 122 (only the lower end of which is shown) carrying a knurled thumb screw 124 at the top thereof, FIGS. 1, 3 and 5, threadedly couples the inboard three wedges 116 of member 114 to the wedges 112 of member 108. The lower extremity of the vertical shaft 122 is undercut as at 126 and carries an O-ring 128 for wedging engagement in opening 130 in the base member 32. Rotative movement of thumb screw 124 causes the wedges 112 and 116 to move relative to one another forcing the two members 108 and 114 apart and moving the endorsement legend 110 forwardly or rearwardly (leftwardly or rightwardly FIG. 1) effective to compensate for wear and misalignment. By virtue of the press fit and O-ring combination of the legend mount 22 when it is desired or required to completely replace the legend, the mount 22 can be removed by the upward pressure of the operator on the thumb screw in which case the entire assembly is slideably demountable from the grooves for suitable repair or replacement.

Figure 8:
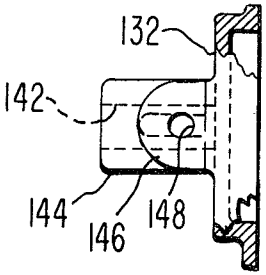
FIG. 8 is a view taken along the line 8—8 of FIG. 7.
Figure 9A:
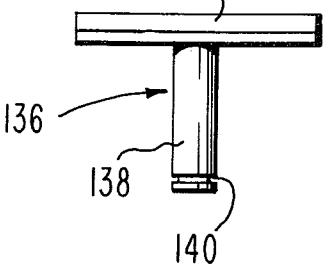
FIG. 9*a* is a side elevational view of the platen insert and solenoid drive connection.
Figure 7:
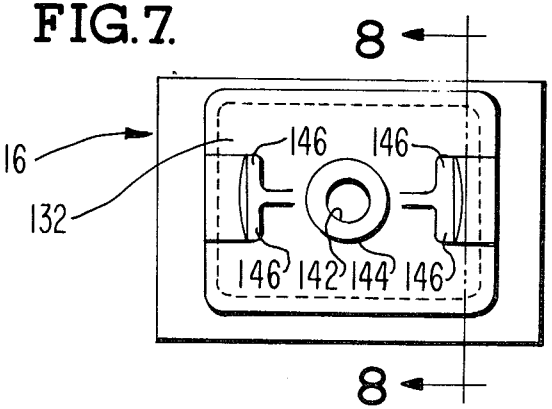
FIG. 7 is a view taken along the line 7—7 of FIG. 2 (the spring not being shown)
Figure 9:
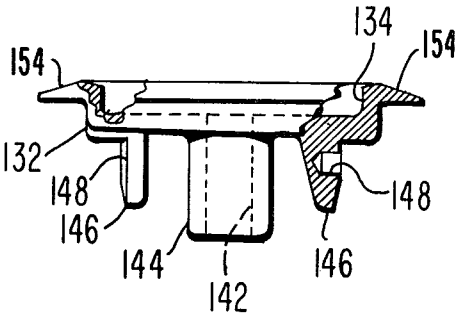
FIG. 9 is a top plan view of the platen of FIG. 8 with the end partially in section to illustrate the novel construction involved in this piece of apparatus.

The printing platen assembly 16 is seen in FIGS. 1, 2 and particularly in FIGS. 7, 8 and 9 to comprise a rectangular, rigid, anvil like support member 132 of Delrin or Nylon or similar material, arranged in confronting, facing relationship to the print head 20. The front portion of member 132 is provided with a rectangular recess 134, FIG. 9, for reception therein of a rigid support member 136, FIG. 9*a*.

Member 136 is T-shaped in cross section including a vertical, cylindrical plunger like member 138 integral with the body portion 136. A circular groove 140, for purposes to be described later on, is cut or formed in the lower terminal end of plunger 138. Member 136 is adapted to be slideably movable within the recess 134 and on into the cylindrical opening 142 in tubular projection 144 integral with the rear portion of member 132. Oppositely disposed integral hinge mounting tabs 146 are each provided with a hinge pin receptacle 148 FIG. 9 for reception therein of a press fitted short hinge pin member 150, FIGS. 1 and 2. Secured as by suitable adhesive to the front surface of member 136 is a rectangularly shaped rubber pad 152, FIGS. 1 and 9*a* respectively providing a semiresilient impact receiving, shock absorbing cushion for the platen member 16. The outer edges of member 132 are angularly chamfered or offset as seen at 154 in FIG. 1 so as to avoid any item hang up as the items pass through item pathway 44 of the device.

Anvil member 132 is biased by oppositely disposed springs 155, FIG. 2 one end of each one of which is secured to a respective hinge pin 150 while the opposite end of each spring 155 is secured to a pressed out or bent over tang or tab 157, disposed on opposite sides of a u-shaped gimbal support bracket member 159 (shown in top plan FIG. 1 and in side elevation in FIG. 2). As seen most clearly in FIG. 2, the hinge pin members 150 project outwardly into and through respective elongated openings of slots 161 in the forwardly extending opposite ends of the u-shaped gimbal support bracket 159. As will become clear hereinafter, in connection with the description of the drive means for platen 16, the aforedescribed structural configuration permits the anvil member 132 to move or rock about a vertical as well as a horizontal plane and also to move forwardly and rearwardly within slots 161. This movement partakes of a gimbal mounting.

Drive means for compound platen 16 is seen in FIGS. 1 and 2 to comprise a metal shielded drive coil (not shown) surrounding a rod like plunger 156 including a rearward circular stop member 158 and a forwardly extending cylindrical housing 160 into and through which the rightward end 162 of plunger 156 projects into abutting contact with the rearward end 164 of member 138. An enlarged return spring member 166 surrounds the tubular projection 144. One end of spring 166 seats against the rear surface of member 132 while the opposite end is retained by means of the circular collar member 168 disposed in groove 140 of member 138. Energization of solenoid coil over leads 170 from a source of signal potential, not shown, will cause the platen 16 to be driven forwardly (rightwardly FIGS. 1 and 2) against the tension of spring 166 while automatically returning the platen to its rest (withdrawn) leftward position when the signal is interrupted. As a result of the gimbal mounting configuration, the present apparatus is capable of accommodating variations in the thickness of items without misprinting the applied data or indicia.

As seen in FIGS. 10 through 14 inclusive, a relatively inexpensive but novel drive means 28 is employed to provide signal energized actuation (i.e. rotation) of the movable print wheel assemblies of the print head 20 of the present invention. An irregularly but roughly U-shaped bracket 172 having an integral L-shaped extension 174 forms a mounting support for a solenoid coil 176 which is secured thereto by means of the hex nut 178 on the lower threaded end of core 180. Core 180 extends vertically upwardly through the coil and is exposed for a very short distance in the neighborhood of the clapper as will be described. The lower end of the core 180 is threaded permitting the gap between the clapper 182 and the top of the core to be adjusted precisely as needed. The horizontally disposed clapper 182 is angularly, rockably, pivotally mounted between opposite side walls of the U-shaped member 172 by means of oppositely disposed notches (not shown) therein. A coiled spring 184 secured at its opposite end to a staked out tab or tang 186 in the lower portion of member 174 biases the clapper into an inoperative position, FIG. 10, away from the core (pole piece). The solenoid 176 is horizontally disposed relative to the base frame 12 and is mounted to the base frame by means of bolts or screws through attachment holes 188 which places the side wall of the U-shaped member 172 parallel to the flat bed of the base frame 12.

The forward or free end (rightward in FIG. 10) of clapper 182 extends a short distance into the irregularly shaped opening 190 in verge (escapement)actuator 192. Actuator 192 comprises a cast, molded or formed member of Polyacetel or similar material which provides incremental drive (advance) means for the indexable, rotatable, data, amount bank identifier number, sequence number, etc., on items or documents such as checks which may be fed through pathway 44 during operation of the subject apparatus. Actuator 192 is pivotally, rockably mounted between the two confronting side walls of the U-shaped support 172 as seen most clearly in FIGS. 11 and 17. The leftward end of actuator 192 is circularly undercut as at 194 to provide a bearing surface for this end of the actuator as is the opposite end of the actuator as indicated at 196. A central axial bore 198 is drilled or formed in the end of member 192 as seen most clearly in FIG. 12 for press fit retention therein of the verge connector insert member 72, FIGS. 2 and 14. The slotted opening 70 with the chamfered edges opening outwardly therefrom permits the member 72 to matingly engage the flats 66, FIG. 2, secured to the verge escapement pawl 56, FIG. 16. An integral stop 200 formed in the actuator member 192 is adapted to abut the spacer member 202, FIG. 11, when the clapper is in the spring biased, disengaged or inactive position, FIG. 10, as when the print head is removed.

Figure 16:
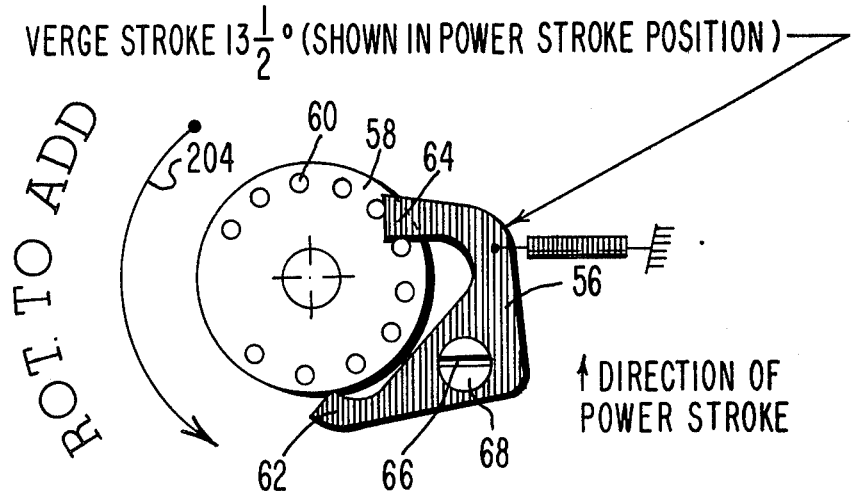
FIG. 16 is a view taken along the line 16—16 of FIG. 4 illustrating the pin wheel drive and escapement (verge) mechanism.

Rotative torque is transmitted, as before mentioned, from a solenoid clapper 182 via the interconnector 72 to the verge shaft 68 secured, as for example by press fitting, to the verge or escapement pawl 56, FIG. 16. In the top plan view of FIG. 16, the two opposite ends 62 and 64 of the pawl are illustrated in the engaged or power stroke position with respect to the vertically disposed equally spaced pins 60 of pin wheel 58 secured to the lowermost level of the multiwheel shaft 50, FIG. 4, of the print head wheel assembly 20. In the position shown, the upper pawl end 64 is disposed between two of the pins 60 of pin wheel 58, while the lower pawl 62 is disengaged and withdrawn from between two of the pins 60. Upon deactuation of the solenoid 176, clapper 182 is released from pole piece 180, rocking actuator 192 clockwise (CW), rotating verge pawl 56 counterclockwise (CCW) pushing pawl end 62 between two of the pins 60 while pawl end is moved into engagement with the next pin to the right, FIG. 16, causing the pin wheel 58 to rotate counterclockwise (CCW) arrow 204 thereby advancing the data wheels of the print head 20 by one increment.

Since the actuator 192 is employed to drive, move or rotate the unit's digit of the sequence counter of the print head wheels of the assembly 20, and since the wheel assemblies are subject to the dust, dirt, grime and stickiness of the ink which necessarily accumulates thereon as the wide band ribbon and the wheels rotate relative to one another, there is a tendency for the ink to build up on the assembly. This action results in a build up of resistance forces, i.e. resistance to the start up action of the wheel assemblies. Thus, a relatively large force is required to initially turn these wheels, but yet such force must not exceed the Hertzian stress of the material, e.g. plastic, of which the wheels are formed. What is therefore required is a clapper stroke sufficient to overcome the ink build up but which tends to decrease or remain constant during the movement of the clapper.

Figure 17:
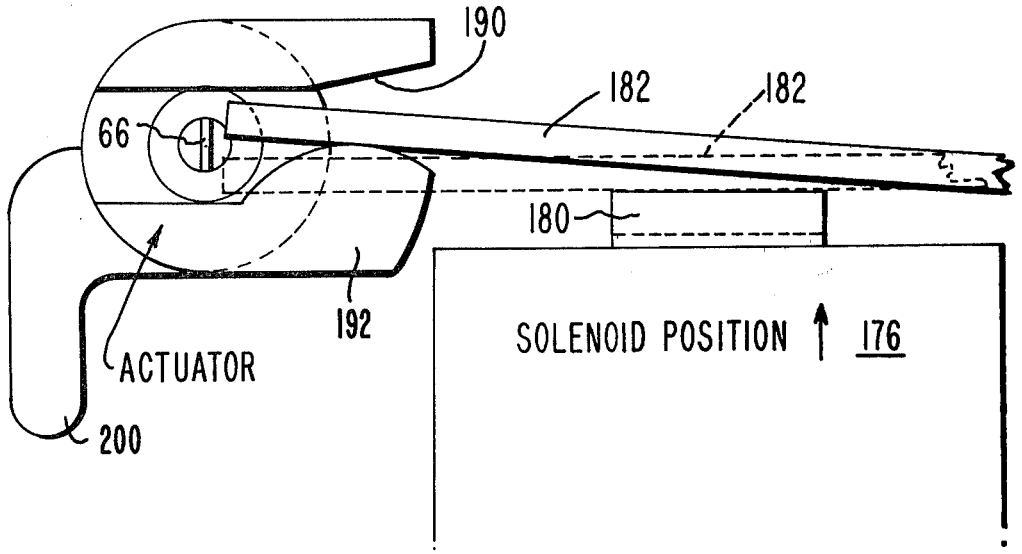
FIG. 17 is a schematic view of the novel solenoid clapper actuator construction of the present invention.

The novel design as illustrated in FIG. 17 of the drawings acts to decrease the force being transmitted to the sequence wheels although the force between the solenoid and the clapper is actually increasing as the actuation takes place. However, due to the change in radius at the actuator as the actuator is being pivoted, the radius is reduced so that the force times radius which produces the torque output being transmitted is controllable to be either a constant force or to increase at a slight rate or even decrease depending upon the chosen design of the curvature of the actuator.

Figure 18:
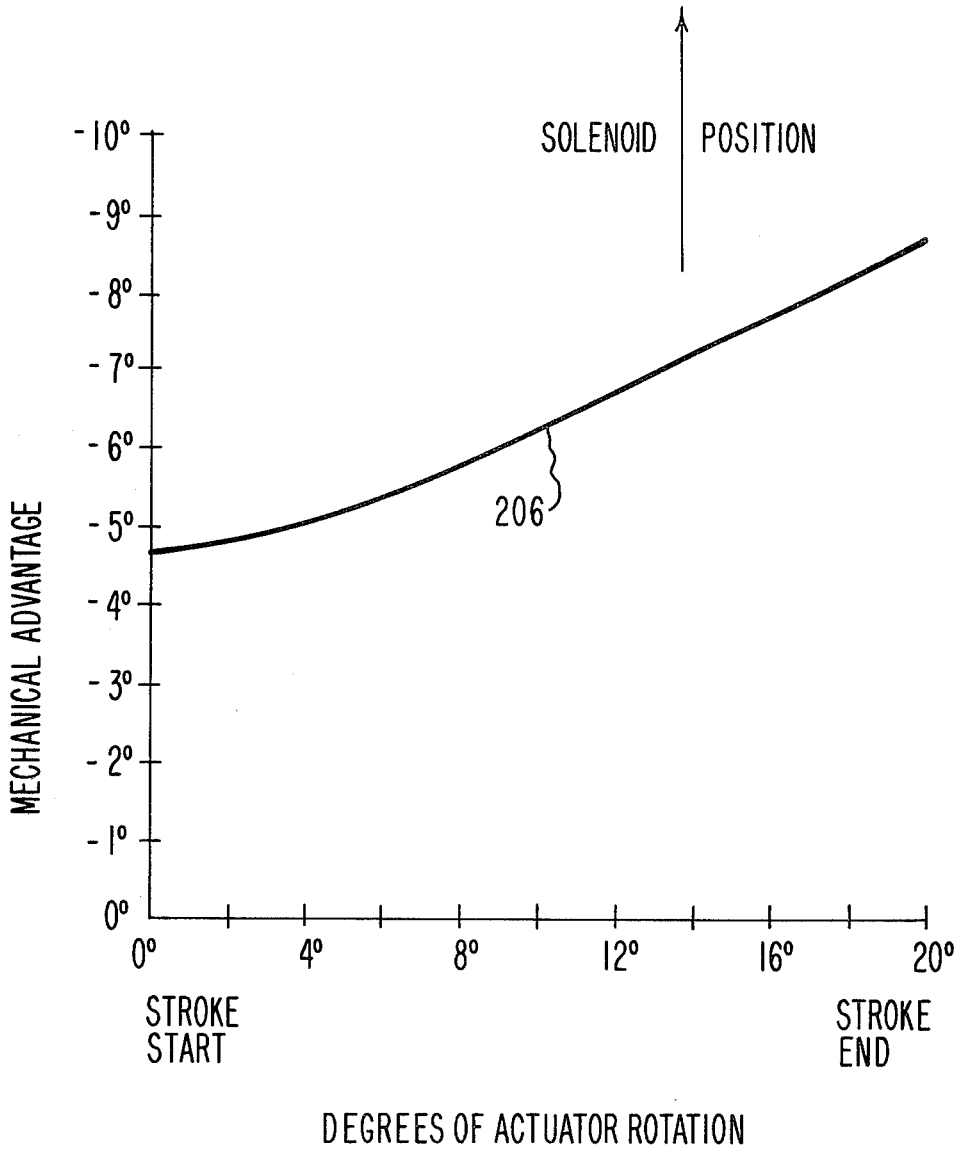
FIG. 18 is a graph illustrating the mechanical advantage of the novel apparatus of FIG. 17.

The curve 206 of the graph of FIG. 18 illustrates the mechanical advantage gained versus the degree of actuator rotation for the present inventive combination. The verge stroke as shown in FIG. 16 is approximately 13½°. Assuming that the maximum stroke travel is employed, it can be seen in FIG. 18 that the mechanical advantage which is almost linear goes from 4.75° to approximately 9° which is almost a two-to-one advantage. Thus, it is possible by design to produce an almost flat torque curve, totally independent of the position of the actuator relative to the clapper.

DEMOUNTABLE PRINT HEAD EMBODIMENT

Figure 19:
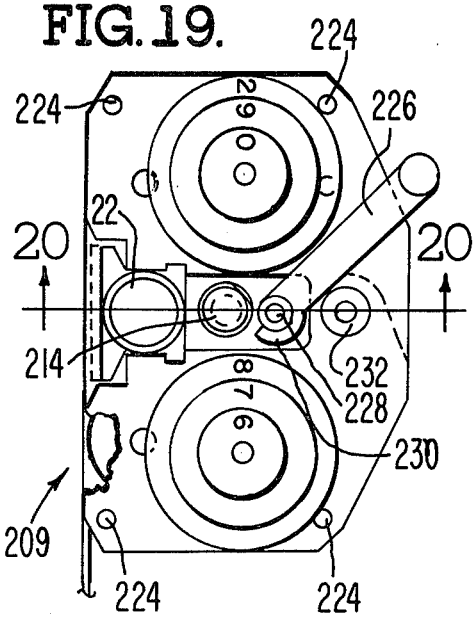
FIG. 19 is a top plan view of the novel demountable print head construction embodying the present invention.
Figure 20:
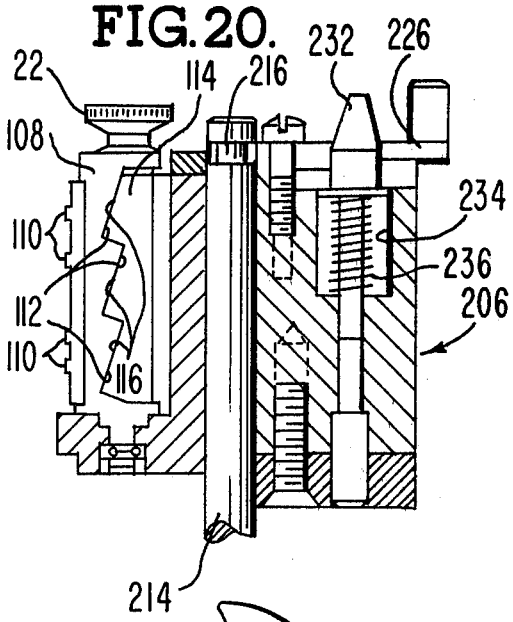
FIG. 20 is a view taken along the line 20—20 of FIG. 19.
Figure 21:
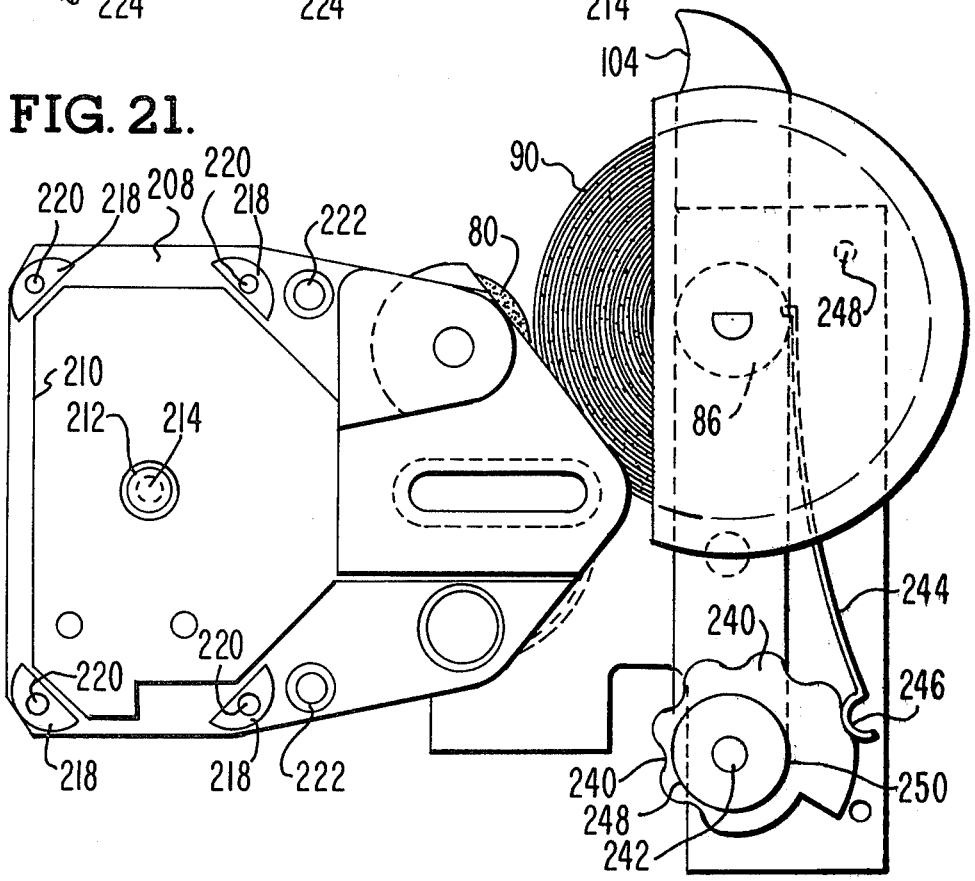
FIG. 21 is a top plan view similar to FIG. 1, illustrating the base support construction for the demountable print head arrangement.

A novel modification of the present invention is illustrated in FIGS. 19, 20 and 21 wherein there is shown a demountably, removable, replaceable print head assembly 209. which, except for the differences noted herein, is substantially similar to print head 20. However, it is noted that removal of the print head does not disturb the ribbon or inking system.

A base support member 208 for mounting and dismounting print head assembly 209, FIG. 19, is seen in FIG. 21 to comprise an irregularly shaped member provided with a substantially rectangular recess or depression 210 formed therein corresponding in external configuration to the general outline configuration of the demountable print head assembly 209 of FIG. 19. A central mounting aperture 212 in base support 208 is adapted to receive a vertical, cylindrical support guide rod 214 rigidly secured therein. The upper extreme end of guide rod 214 is provided with an undercut or circular groove 216, for purposes to be described presently.

Secured to the four opposite corners of base support 208 are individual, half-cylindrical, vertically disposed posts 218, the top portion of each one of which is provided with reduced circular pin like projections 220. Base support 208 is secured to frame 12 by means of bolts 222. Cylindrical openings 224 in demountable print head 209 permit head 209 to be fixedly oriented on base 208 with the four pins 220 received through the mating openings 224.

In order to retain print head 209 on base 208 a rockable lever 226 pivoted at 228 is provided with a radially curved C-shape end portion 230 for sliding engagement in groove 216 as lever 226 is moved clockwise or downwardly, FIG. 19. A curved conical shaped plunger 232 slideable within a cylindrical opening 234 in the body portion of print head 209 against the tension of spring 236 when depressed permits the lever 226 to be moved across its top to the opposite side (downwardly as viewed in FIG. 19) to the locked position in which the head is firmly fixed to the base 208 and the frame 12. The endorsement legend carrier or mount 22 is substantially identical with the carrier 22 of FIGS. 1 and 2 as earlier described herein.

Another feature of the endorser of the present invention is illustrated to the right of FIG. 21 wherein the inking roll assembly 26 which is lever mounted as in FIGS. 1 and 2 is provided with a rotatable cam member 238 having a plurality of cam protuberances 240 arcuately, helically disposed about a mounting shaft 242. A flat planar leaf spring 244 having a radial cam follower 246 at one end riding on cam 238 and secured at its opposite end to a slot 248 in mounting shaft 86 biases the inking roll 90 towards the drive roller 80. Rotation of knurled handle member 250 increases or decreases the tension of spring 244 on inking roller 90 as required or desired as the ink is depleted from the roller.

What is claimed is:

1. Holding force pressure type endorsing apparatus for use with document processing equipment wherein individual items, such for example as checks or documents, may be printed upon the obverse or reverse side thereof depending upon the application requirement, and wherein the complete endorsing assemblage is demountably removable from its associated apparatus for replacement, repair, adjustment and/or service as required, comprising a supporting base, print producing means demountable, removable, cantilevered to said base;

signal controlled impact gimbal mounted platen means disposed adjacent to said print producing means and capable of deflecting in directions at right angles to one another and forming together with said print producing means an item receiving passageway into and through which an item/document may be moved for receiving a printed legend or other such information thereon from said print producing means;

drive means for moving an inking member through said item passageway between said impact producing platen means and said print producing means for effecting printing on an item interposed into said passageway;

means for applying fresh ink to said inking member as the ink is depleted therefrom as a result of the printing operation;

incremental, signal controlled holding force pressure drive means for said print producing means for advancing said print producing means in response to an applied signal representing sequential data desired to be printed upon each successive item, and for pressing said platen into said item momentarily stopping said item and means providing an adjustable legend mount operably associated with said print producing means for simultaneously applying additional fixed content printed information to said item as the item is stopped within said passageway;

said legend mount being vertically, slidably, demountably captivated in said base and including means for horizontally displacing said mount relative to said item passageway and for snap out dismounting from said base for changing or renewing the data carried thereon.

2. The invention in accordance with claim 1, wherein said ink applying member is demountably supported on a rockable lever and includes A multifaceted cam member operably engaging biasing means for adjustably tensioning said ink applying member against said inking member.

3. The invention in accordance with claim 1, wherein the coupling between said drive means and the controlled impact producing means comprises the juncture between two opposing coaxial shaft ends with the shaft ends biased into constant but unconnected contact engagement effective to avoid misalignment problems thus avoiding image ghosting on said item.

4. The invention in accordance with claim 1, wherein said fixed content printed information producing means compromises a unitary, self contained, demountable, removable, changeable assembly a vertically threaded member including for threadedly adjusting the horizontal orientation of said assembly relative to said impact platen means.

5. The invention in accordance with claim 1 wherein said signal controlled platen means for advancing said print producing means further comprises electromagnetic actuator means including an elongated clapper member operably coupled to said print producing means and a member member interengaging said clapper and said print producing means, the open end of said clapper having a radially shaped portion effective when said clapper is moved to provide a force times radius effect whereby the transmitted torque is controlled so as to be a constant pressure for the duration of the period of actuation of the clapper.

6. The invention inaccordance with claim 5 wherein said radially curved portion has a radius of curvature relative to said clapper member such that pivotal movement of said clapper member results in a reduction in the radius of curvature effectively producing a constant torque output from said assembly resulting in a decrease in force pressure transmitted to the printing means.

7. The invention in accordance with claim 1 wherein said inking member is a continuous loop of inked fabric separate from but encircling said print producing means, and wherein said base includes an elongated aperture at one end and a vertically extending slack adjusting shaft carrying a tensioning member operably engaging said continuous loop, horizontally movable locking means on said print producing means is operably engageable with detent means on said supporting shaft to demountably lock said print producing means to said base within said continuous loop.

8. Holding force pressure type endorsing apparatus for use with document processing equipment wherein individual items, such for example as checks or documents, may be printed upon the obverse or reverse side thereof depending upon the application requirement, and wherein the complete endorsing assemblage is demountably removable from its associated apparatus for replacement, repair, adjustment and/or service as required, comprising a supporting base including an irregularly shaped recess therein, an elongated aperture at one end of said base and a vertically extending supporting shaft secured to said base, print producing means demountably, slideably received on said supporting shaft coupling said print producing means to said base and seated within said recess, horizontally movable locking means on said print producing means and detent means operably engageable with said locking means and said supporting shaft, continuous inking means separable from but surrounding said print producing means, slack adjusting means for said inking means adjustably vertically movable relative to said base and said inking means, and shaft drive means operably associated with said print producing means for accurately orienting said print producing means relative to said base and to an operably associated item pathway.

* * * * *